US009862578B2

(12) United States Patent
Jones

(10) Patent No.: US 9,862,578 B2
(45) Date of Patent: Jan. 9, 2018

(54) TILTABLE AND ROTATABLE LIFTING POLE ASSEMBLY

(71) Applicant: Kathy Jones, Lynnville, IN (US)

(72) Inventor: Ernest R. Jones, Lynnville, IN (US)

( * ) Notice: Subject to any disclaimer, the term of this patent is extended or adjusted under 35 U.S.C. 154(b) by 0 days.

(21) Appl. No.: 15/092,825

(22) Filed: Apr. 7, 2016

(65) Prior Publication Data

US 2016/0340155 A1 Nov. 24, 2016

Related U.S. Application Data

(60) Provisional application No. 62/165,488, filed on May 22, 2015.

(51) Int. Cl.
*B66C 23/20* (2006.01)
*H01Q 1/12* (2006.01)

(52) U.S. Cl.
CPC ..... *B66C 23/203* (2013.01); *H01Q 1/1242* (2013.01)

(58) Field of Classification Search
CPC ..... E21B 15/00; E21B 7/023; E04H 12/187; E04H 12/182; E04H 12/34; E04H 12/345; E04H 12/18; B66C 23/203; B66C 23/205; B66C 23/64; B66C 23/202; B66C 23/60; H01Q 1/1242
USPC ..... 52/114, 116, 117, 118, 119, 120; 212/175, 179, 239, 262, 271
See application file for complete search history.

(56) References Cited

U.S. PATENT DOCUMENTS 1,003,072 A * 9/1911 Taylor ..... B66C 23/84 212/175
2,284,360 A * 5/1942 Berby ..... E04H 12/187 187/242
2,380,094 A * 7/1945 Woolslayer ..... E21B 15/00 52/120
2,804,979 A * 9/1957 Lassiter ..... B66C 23/48 212/202
2,822,066 A * 2/1958 Hanson ..... E04H 12/187 416/142

(Continued)

*Primary Examiner* — Brian E Glessner
*Assistant Examiner* — Adam G Barlow
(74) *Attorney, Agent, or Firm* — Martin IP Law Group; C. Richard Martin

(57) ABSTRACT

A lifting pole assembly configured for removable attachment to a tower comprising a lifting pole, a bottom bracket assembly, a top bracket assembly and vertical tilt means. The lifting pole has a lower end and an upper end. The bottom bracket assembly includes a first end attached to the tower and a second end attached to the lifting pole proximal to the lower end thereof. Similarly, the top bracket assembly includes a first end attached to the tower at a position above the point where the bottom bracket is attached to the tower and a second end attached to the lifting pole at a position above the point where the bottom bracket is attached to the lifting pole. The vertical tilt means enables the lifting pole to pivot in the vertical plane about a point proximal to the connection between the bottom bracket and the lower end of the lifting pole. Horizontal pivot means for enabling the lifting pole to pivot in the horizontal plane relative to the tower may also be provided. The horizontal pivot means includes a bottom mount bracket of the bottom bracket assembly having a first end removably attached to the tower and a second end pivotally attached to a bottom swivel pivot bracket by a bottom swivel bolt connection.

18 Claims, 3 Drawing Sheets

(56) References Cited

U.S. PATENT DOCUMENTS 2,833,423 A * 5/1958 Tucker ..... B66C 23/203 212/179
2,998,856 A * 9/1961 Larsen ..... E02D 13/04 173/122
3,245,180 A * 4/1966 Bules ..... E21B 7/02 52/116
3,268,092 A * 8/1966 Hainer ..... B25J 9/047 212/179
3,306,396 A * 2/1967 Goss ..... E04G 1/36 182/128
3,317,057 A * 5/1967 Gjelsteen ..... B63B 27/04 212/239
4,587,778 A * 5/1986 Woolslayer ..... E21B 15/00 52/116
4,610,365 A * 9/1986 Roed ..... B66C 23/605 212/262
4,934,659 A * 6/1990 Yoke ..... B66C 23/48 254/326
5,064,078 A * 11/1991 Van Staveren ..... B60P 1/548 212/180
5,076,448 A * 12/1991 Ballard ..... B66C 23/48 212/261
5,305,576 A * 4/1994 Giles ..... E04L 31/3211 249/209
5,426,907 A * 6/1995 Franklin ..... B66C 23/203 212/175
5,459,891 A * 10/1995 Reeve ..... A61G 7/1017 212/231
5,782,042 A * 7/1998 Klein ..... E04H 12/187 52/116
5,934,490 A * 8/1999 Mora ..... B25H 1/0007 212/176
6,491,174 B1 * 12/2002 Day ..... B66C 23/52 212/179
7,178,181 B1 * 2/2007 Fulmer ..... A61G 7/1015 212/179
7,341,158 B2 * 3/2008 Toudou ..... B66C 23/344 212/239
7,878,348 B2 * 2/2011 Doggett ..... B64G 4/00 212/239
8,250,826 B1 * 8/2012 Vogt ..... E04H 12/10 52/117
8,375,649 B2 * 2/2013 Grotz ..... B66F 7/28 212/348
8,720,128 B2 * 5/2014 Vogt ..... E21B 15/00 173/28

* cited by examiner

POLE CAN SWIVEL INSIDE TOWER 50
16
14
136
70

12
60
72b
72a

76

102a
102b
102c
74a
74b
74c
74d
75

18a
18b
18c

TILTABLE AND ROTATABLE LIFTING POLE ASSEMBLY

BACKGROUND OF THE INVENTION

1. Field of the Invention

The present invention relates to lifting poles, aka gin poles, that are used to raise loads above structures such as radio towers too tall to reach with a crane, and more specifically, to an improved lifting pole assembly that is engineered to allow a lifting pole to be position in multiple tilted positions relative to the vertical plane and in multiple pivoted positions relative to the horizontal plane.

2. Prior Art

A gin pole is a supported pole which uses a pulley or block and tackle on its upper end to lift loads. The lower end is braced or set in a shallow hole and positioned so the upper end lies above the object to be lifted. The pole (also known as a "mast", "boom", and "spar") is secured with three or more guys. These are manipulated to move the load laterally, with up and down controlled by the pulley or block. The gin pole is considered a form of derrick, called standing derrick or pole derrick, distinguished from sheers (or "shear legs") by having a single boom rather than a two-legged one.

Gin poles are also used to raise loads above structures too tall to reach with a crane, as placing an antenna atop a steeple, and to lift segments of a tower atop one-another during erection. When used to create a segmented tower, the gin pole can be detached, raised, and re-attached to the just completed segment in order to lift the next. This process of "jumping" is repeated until the topmost portion of the tower is completed.

A disadvantage of prior art lifting poles, particularly in the segmented tower field, is that the lifting pole assembly is generally fixed to the tower structure with the lifting pole in a fixed vertical position. This fixed configuration limits the ability of the lifting pole in raising loads of certain dimensions and limits the location from which loads can be lifted. While the mounting position of the lifting pole can be altered to account for such variations, there is no known prior art lifting pole that can be quickly and easily adjusted in the field to alleviate such concerns.

SUMMARY OF THE INVENTION

The present invention overcomes the problems of prior art lifting poles by providing a lifting pole assembly that can be quickly and easily tilted relative to the vertical plane to account for loads of varying dimensions. The present invention also provides a lifting pole that can be quickly and easily rotated in the horizontal plane to relocate the far end of the lifting pole to account for loads in different positions without putting undue stresses on the structure. The lifting pole assembly according to the present invention accomplishes these objectives in a package that can be readily adjusted in the field to meet the needs of any situation.

According to one aspect of the present invention, there is provided a lifting pole assembly configured for removable attachment to a tower comprising a lifting pole, a bottom bracket assembly, a top bracket assembly and vertical tilt means. The lifting pole has a lower end and an upper end. The bottom bracket assembly according to this aspect of the invention includes a first end attached to the tower and a second end attached to the lifting pole proximal to the lower end thereof. Similarly, the top bracket assembly includes a first end attached to the tower at a position above the point where the bottom bracket is attached to the tower and a second end attached to the lifting pole at a position above the point where the bottom bracket is attached to the lifting pole. The vertical tilt means according to this aspect of the invention enables the lifting pole to pivot in the vertical plane about a point proximal to the connection between the bottom bracket and the lower end of the lifting pole.

According to another aspect of the invention, the vertical tilt means further comprises a flange extending outwardly from the lifting pole proximal to the lower end thereof; a swivel mount bracket extending from the bottom bracket; and a pivot pin passing through openings in both the flange and the swivel mount bracket to permit rotation about the axis thereof. The vertical tilt means according to this aspect of the invention may further comprise one or more tie-back arms. Each tie-back arm may further include a first end pivotally attached to a top swivel bracket of the top bracket assembly such that said one or more tie-back arms may rotate in the vertical plane relative to the top swivel bracket and an opening in each of the one or more tie-back arms proximal to a second end thereof. One or more openings extending through the lifting pole along a longitudinal axis thereof may also be provided. A pin configured to pass through the second end openings in the tie-back arms and through one of the openings in the lifting pole may be provided to secure the lifting pole at a desired angle. Lastly, the vertical tilt means may further include a come-along having a first end removably attached to a bracket extending from the lifting pole proximal to the upper end and a second end removably attached to the top pivot bracket.

A further aspect of the invention is to provide horizontal pivot means for enabling the lifting pole to pivot in the horizontal plane relative to the tower. The horizontal pivot means according to this aspect of the invention comprises a bottom mount bracket of the bottom bracket assembly having a first end removably attached to the tower and a second end pivotally attached to a bottom swivel pivot bracket by a bottom swivel bolt connection. The horizontal pivot means may further include a top mount bracket of the top bracket assembly having a first end removably attached to the tower and a second end pivotally attached to a top swivel pivot bracket by a top swivel bolt connection.

According to yet another aspect of the invention, an adjustable anti-rotation bracket having a first end attached to a lateral bracket located along the length of the lifting pole and a second end attached to a bracket affixed to the tower may also be provided. The adjustable anti-rotation bracket may include a first telescoping member slidably disposed within a second telescoping member, and a fastener for releasably securing the first and second telescoping members from movement relative to one another.

According to one aspect of the invention, the bottom bracket assembly and top bracket assembly are removably attached to a vertical leg of the tower. According to an alternative aspect of the invention, the bottom bracket assembly and top bracket assembly are removably attached to a face of the tower by a pair of face mounting brackets.

A further embodiment of the present invention is lifting pole assembly configured for removable attachment to a tower comprising a lifting pole having a lower end and an upper end; a bottom bracket assembly having a first end attached to the tower and a second end attached to the lifting pole proximal to the lower end thereof; a top bracket assembly having a first end attached to the tower at a position above the point where the bottom bracket is attached to the tower and a second end attached to the lifting pole at a position above the point where the bottom bracket is attached to the lifting pole; and horizontal pivot means for enabling the lifting pole to pivot in the horizontal plane relative to the tower.

A further aspect of this embodiment of the invention is that the horizontal pivot means comprises a bottom mount bracket of the bottom bracket assembly having a first end removably attached to the tower and a second end pivotally attached to a bottom swivel pivot bracket by a bottom swivel bolt connection. The horizontal pivot means may further comprise a top mount bracket of the top bracket assembly having a first end removably attached to the tower and a second end pivotally attached to a top swivel pivot bracket by a top swivel bolt connection. Still further, an adjustable anti-rotation bracket may be provided having a first end attached to a lateral bracket located along the length of the lifting pole and a second end attached to a bracket affixed to the tower. The adjustable anti-rotation bracket may include a first telescoping member slidably disposed within a second telescoping member, and a fastener for releasably securing the first and second telescoping members from movement relative to one another.

A further aspect of this embodiment is to provide vertical tilt means for enabling the lifting pole to pivot in the vertical plane about a point proximal to the connection between the bottom bracket and the lower end of the lifting pole. The vertical tilt means may preferably include a flange extending outwardly from the lifting pole proximal to the lower end thereof; a swivel mount bracket extending from the bottom bracket; and a pivot pin passing through openings in both the flange and the swivel mount bracket to permit rotation about the axis thereof. The vertical tilt means may further include one or more tie-back arms, each tie-back arm having a first end pivotally attached to a top swivel bracket of the top bracket assembly such that said one or more tie-back arms may rotate in the vertical plane relative to the top swivel bracket and an opening in each of said one or more tie-back arms proximal to a second end thereof, one or more openings extending through the lifting pole along a longitudinal axis thereof; and a pin configured to pass through the second end openings in said tie-back arms and through one of the one or more openings in the lifting pole to secure the lifting pole at a desired angle. The vertical tilt means may further include a come-along having a first end removably attached to a bracket extending from the lifting pole proximal to the upper end and a second end removably attached to the top pivot bracket.

These and other features, aspects and advantages of the present invention will be more readily apparent from a review of the drawings and detailed description below.

BRIEF DESCRIPTION OF THE DRAWINGS

Embodiments of invention may best be understood by referring to the following description and accompanying drawings that are used to illustrate embodiments of the invention. In the drawings.

DETAILED DESCRIPTION OF PREFERRED EMBODIMENTS

Figures 1, 2A, 2B, 3A, 3B, 4, 5, 6, 7:
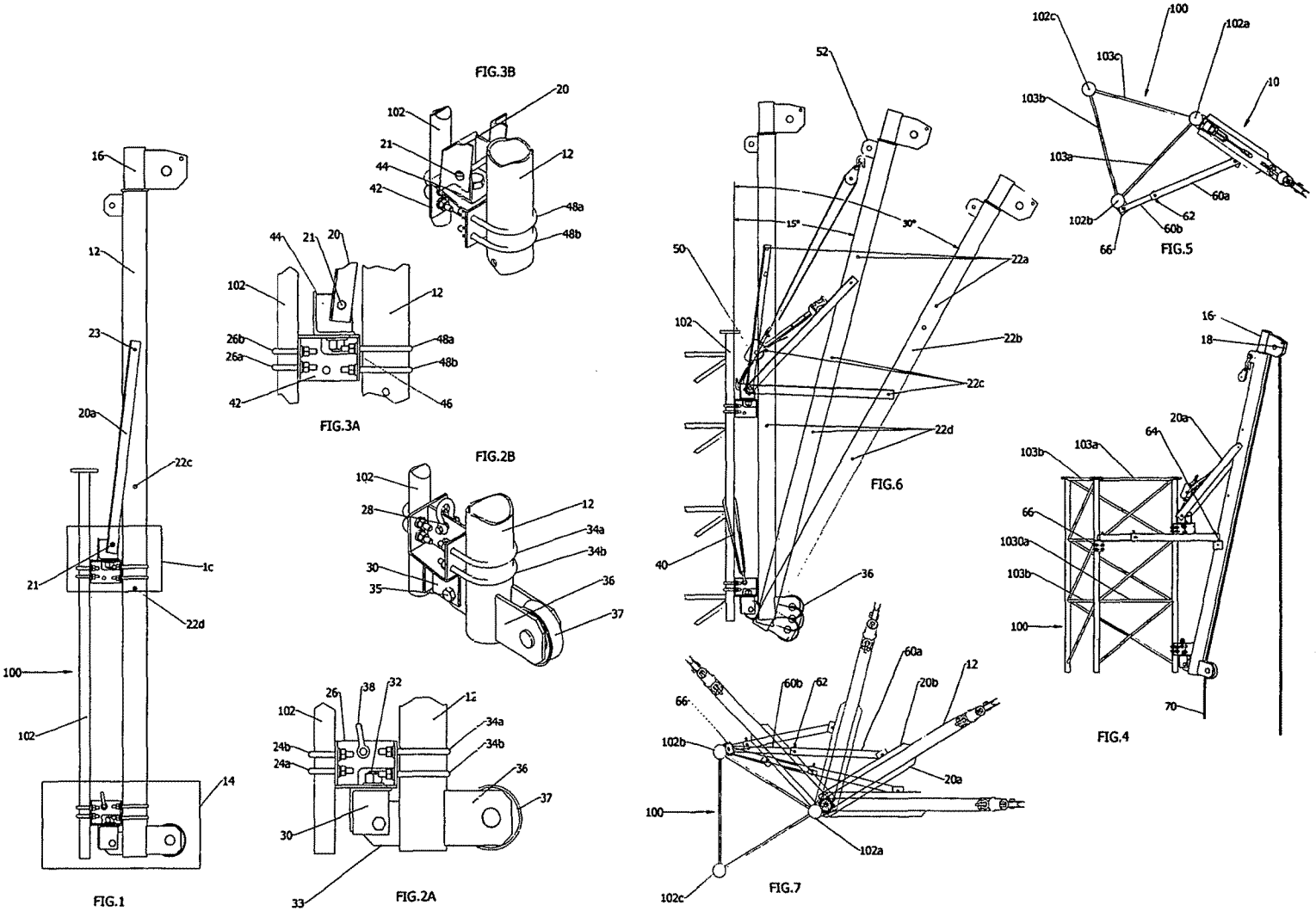
FIG. 1 is a side elevational view of an improved lifting pole according to one preferred embodiment of the present invention.
FIG. 2A is a detailed side elevational view of the bottom bracket assembly shown in the area designated 14 in FIG. 1.
FIG. 2B is a detailed perspective view of the bottom bracket assembly shown in the area designated 14 in FIG. 1.
FIG. 3A is a detailed side elevational view of the top bracket assembly shown in the area designated 16 in FIG. 1.
FIG. 3B is a detailed perspective view of the bottom bracket assembly shown in the area designated 16 in FIG. 1.
FIG. 4 is a perspective view of an improved lifting pole according to another presently preferred embodiment of the present invention, with the lifting pole shown mounted on a tower leg.
FIG. 5 is a top plan view of the improved lifting pole shown in FIG. 4.
FIG. 6 is a side elevational view of an improved lifting pole according to another preferred embodiment of the present invention, showing a multi-tilt layout.
FIG. 7 is a top plan view of an improved lifting pole according to another aspect of the present invention, showing a multi-rotational layout.

FIGS. 1-7 show an improved lifting pole assembly 10 according to one preferred embodiment of the present invention. The lifting pole assembly 10 according to this embodiment includes a lifting pole 12 having a bottom bracket assembly 14 located at a first lower end thereof, a head assembly 18 located at a second upper end thereof, and a top bracket assembly 16 located along the length of the lifting pole 12 between the bottom bracket assembly 14 and head assembly 18. A pair of tie-back arms 20*a*, 20*b* are used to fix the lifting pole assembly 10 in a number of predetermined tilt positions. The tie-back arms 20*a*, 20*b* are pivotally connected to the top bracket assembly by a pivot pin 21. It is understood that any equivalent structure, such as a bolt, that permits rotation may be used in place of pivot pin 21. The lifting pole 12 has a plurality of pre-drilled holes 22*a*, 22*b*, 22*c*, 22*d* for receiving a removable pin 23 to lock the lifting pole in a particular tilt layout. For example, as shown in FIG. 6, when the pin 23 aligns with the hole in the second end of the tie-back arms 20*a*, 20*b* and the first hole 22*a* in the lifting pole 12, the lifting pole is oriented in the vertical position; when the pin 23 aligns with the hole in the second end of the tie-back arms 20*a*, 20*b* and the second hole 22*b* in the lifting pole 12, the lifting pole is oriented 15 degrees from the vertical position; and when the pin 23 aligns with the hole in the second end of the tie-back arms 20*a*, 20*b* and the third hole 22*c* in the lifting pole 12, the lifting pole is oriented 30 degrees from the vertical position.

The lifting pole assembly 10 may be removably attached to a tower 100 for hoisting tower components, antennas of other fixtures onto the tower. As shown in FIGS. 1-7, the lifting pole assembly may be removably attached to a vertically oriented tower leg 102 by a plurality of u-bolts 24*a*, 24*b* attached to the bottom bracket assembly 14 and a plurality of u-bolts 26*a*, 26*b* attached to the top bracket assembly 16. It is understood by those of skill in the art that equivalent structures and devices, such as universal clamps, can be used in place of the u-bolts to removably attach the lifting pole assembly 10 to the tower 100 without altering the spirit of the present invention. Similarly, while FIGS. 1-7 show the lifting pole assembly 10 attached to a vertically oriented tower leg 102, one of skill in the art would recognize that the lifting pole assembly 10 could readily be adapted to attach to a horizontal cross member or other component of a tower assembly.

As best shown in FIGS. 2A-2B, the bottom bracket assembly 14 includes a bottom mount bracket 28 which is removably affixed to a tower leg 102 by u-bolts 24*a*, 24*b*. The bottom mount bracket 28 is pivotally attached to a swivel pivot bracket 30 by a swivel bolt connection 32 such that the swivel pivot bracket 30 is rotatable in the horizontal plane relative to the bottom mount bracket 28. The swivel bolt connection 32 is loosely fitted to allow for such rotation. The swivel mount bracket 30 is pivotally attached to a flange 33 extending outwardly from a lower edge of the lifting pole 12. A pivot bolt 35 passes through openings in the swivel mount bracket 30 and flange 33 to allow the flange 33 and attached lifting pole 12 to rotate in the vertical plane relative to the swivel mount bracket 30. A bottom sheave 36 having a pulley 37 rotatably disposed therein extends outwardly from the lower end of the lifting pole in a position substantially opposing the position of the flange 33. When the lifting pole 12 is located in the vertical position, u-bolts 34*a*, 34*b* may be used to removably affix the bottom mount bracket 28 to the lifting pole 12, thus securing the lifting pole from tilting and providing additional support and stability. However, prior to tilting the lifting pole 12, the u-bolts 34*a*, 34*b* must be removed to permit rotation about the pivot bolt 35. Lastly, a shackle 38 may be provided in the bottom mount bracket 28 for attaching a sling support or leg connection 40 positioned on an inner member. The primary purpose of the sling support 40 is to prevent the u-bolts 24*a*, 24*b* from sliding down the vertical axis of the tower leg 102 under the weight of the lifting pole assembly 10 and associated load. It will be readily understood by one of skill in the art that where a lifting pole assembly bracket is affixed to, or sitting on, a horizontal cross-member instead of to a vertical tower leg 102, the use of a sling support may not be required or desirable.

As best shown in FIGS. 3A-3B, the top bracket assembly 16 includes a top connection bracket 42 which is removably affixed to a tower leg 102 by u-bolts 26*a*, 26*b*. The top connection bracket 42 is pivotally attached to a top swivel bracket 44 by a swivel bolt connection 46 such that the top swivel bracket 44 is rotatable in the horizontal plane relative to the top connection bracket 42. The swivel bolt connection 46 is loosely fitted to allow for such rotation. The top swivel bracket 44 is pivotally attached to first ends of the plurality of tie-back arms 20*a*, 20*b* by pivot pin 21*a*, to allow the tie-back arms 20*a*, 20*b* to rotate in the vertical plane relative to the top swivel bracket 44. When the lifting pole 12 is located in the vertical position, u-bolts 48*a*, 48*b* may be used to removably affix the top connection bracket 42 to the lifting pole 12, thus securing the lifting pole 12 from tilting and providing additional support and stability. However, prior to tilting the lifting pole 12, the u-bolts 48*a*, 48*b* must be removed.

As best shown in FIG. 6, a come along 50 may be utilized to assist with tilt adjustment of the lifting pole 12. Preferably, the come along has a first end removably attached to a bracket 52 extending from the upper end of the lifting pole 12 and a second end removably attached to the top pivot bracket 44. The come along 50 may be used to raise or lower the lifting pole to the desired position where the holes in the second ends of the tie-back arms 20*a*, 20*b* line up with one of the sleeved pin bracket position holes 22*a*, 22*b*, 22*c*, 22*d* in the lifting pole 12. The pin 23 may then be inserted through the openings in the tie-back arms 20*a*, 20*b* and the corresponding one of the sleeved pin bracket position holes 22*a*, 22*b*, 22*c*, or 22*d* to secure the lifting pole 12 at the desired angle. Once the pin 23 is in place, the come along 50 may be removed. Alternatively, the come along 50 may remain in place to provide additional support.

A common tower configuration in the industry includes a plurality of vertically oriented tower legs, and preferably three tower legs 102*a*, 102*b*, 102*c* as shown in FIGS. 4, 5 and 7. The tower legs 102*a*, 102*b*, 102*c* are connected to one another by a plurality of corresponding horizontal supports 103*a*, 103*b*, 103*c*. Additional sets of horizontal supports (i.e. 103*a*', 103*b*', 103*c*') may be located at regular or irregular intervals along the length of the tower as shown in FIG. 4. The tower configuration is exemplary and does not comprise a part of the present invention as the present invention may be used with a tower having any configuration of vertical and horizontal support members.

As described previously, the bottom bracket assembly 14 and top bracket assembly 16 include components that permit the lifting pole assembly 10 to rotate relative to the horizontal plane. To control this horizontal rotation and to secure the lifting pole assembly 10 in place once the desired horizontal position is achieved, an adjustable anti-rotation bracket 60 is provided. The anti-rotation bracket 60 may preferably include first and second telescoping members 60*a*, 60*b* that slide relative to one another to vary the total length of the anti-rotation bracket 60. Once the desired position is achieved, the first and second telescoping members 60*a*, 60*b* may be fixed in place relative to one another by a fastener such as a set screw 62. The first telescoping member 60*a* is pivotally attached to a lateral bracket 64 located along the length of the lifting pole 12. Similarly, the second telescoping member 60*b* is pivotally attached to a bracket 66 that is affixed to the second tower leg 102*b* by conventional means. As shown in FIG. 4, a load line 70 passes through a pulley 19 in the head assembly 18 and then through the pulley 37 at the base of the lifting pole 12. The lifting operation will be described in greater detail in the following paragraphs.

Figures 8A, 8B, 8C, 9A, 9B, 9C, 9D, 10A, 10B, 10C, 11, 12A, 12B, 12C:
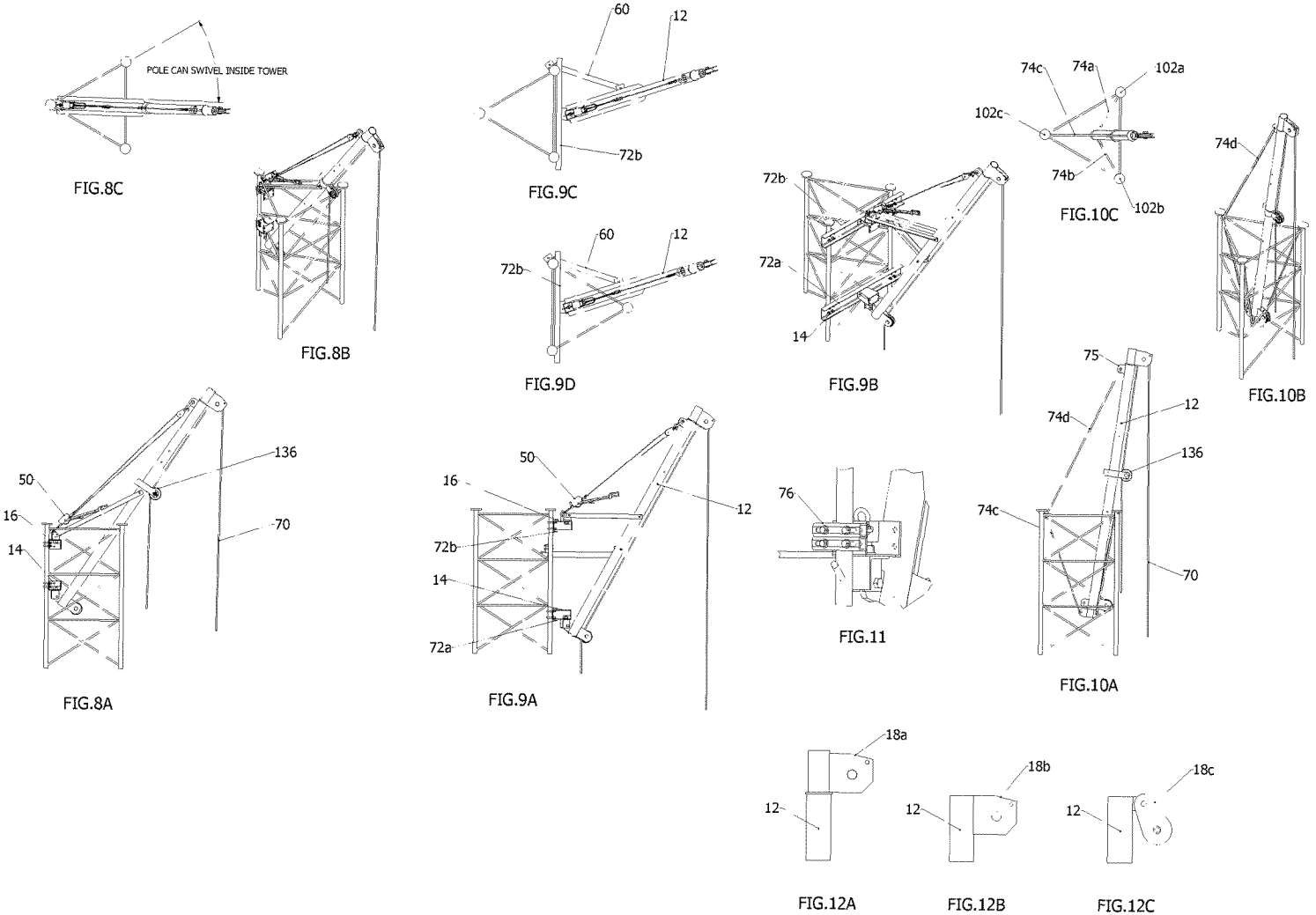
FIG. 8A is a side elevational view of an improved lifting pole according to another aspect of the present invention, with the lifting pole shown mounted inside the tower.
FIG. 8B is a perspective view of the improved lifting pole shown in FIG. 8A.
FIG. 8C is a top plan view of the improved lifting pole shown in FIG. 8A and FIG. 8B.
FIG. 9A is a side elevational view of an improved lifting pole according to another aspect of the present invention, with the lifting pole shown mounted on the face of a tower.
FIG. 9B is a perspective view of the improved lifting pole shown in FIG. 9A.
FIG. 9C is a top plan view of the improved lifting pole shown in FIG. 9A and FIG. 9B.
FIG. 9D is a top plan view of the improved lifting pole according to a further aspect of the present invention, with the lifting pole shown mounted on an inside face of a tower.
FIG. 10A is a side elevational view of an improved lifting pole according to another aspect of the present invention, with the lifting pole shown in a sling mounted configuration.
FIG. 10B is a perspective view of the improved lifting pole shown in FIG. 10A.
FIG. 10C is a top plan view of the improved lifting pole shown in FIG. 10A and FIG. 10B.
FIG. 11 is a detailed view of the universal clamp of the improved lifting pole according to another aspect of the present invention.
FIG. 12A is a detailed view of the head portion of the improved lifting pole according to one aspect of the present invention.
FIG. 12B is a detailed view of the head portion of the improved lifting pole according to an alternative aspect of the present invention.
FIG. 12C is a detailed view of the head portion of the improved lifting pole according to a second alternative aspect of the present invention.

The lifting pole assembly 10 may be mounted on a conventional tower 100 in a variety of ways. As shown in FIGS. 8A-8C, the lifting pole assembly 10 may be mounted inside the tower 100, such that the lifting pole assembly can swivel inside the tower 100 between second and third vertical tower legs 102*b*, 102*c*. In this configuration, the base sheave may be positioned at a location other than the lower end of the lifting pole 12 to allow the load line to be located outside the tower. Accordingly, an adjustable base sheave 136 which can be removably secured to a variety of positions along the length of the lifting pole 12 is provided. According to a further embodiment of the present invention, as shown in FIGS. 9A-9D, the lifting pole assembly 10 can be attached to a face of the tower rather than to a vertical tower leg. According to this embodiment, a pair of face mounting brackets 72*a*, 72*b* are provided which correspond to the bottom bracket assembly 14 and top bracket assembly 16, respectively.

As shown in FIG. 9B, the face mounting brackets 72*a*, 72*b* preferably comprise u-shaped channels with the flanges of the channel facing away from the tower. Alternatively, the channels of the face mounting brackets 72*a*, 72*b* may be positioned with the flanges toward the tower. The ends of the face mounting brackets 72*a*, 72*b* may be affixed to the tower by u-bolts or other conventional means that have been discussed previously. The bottom mount bracket 28 and top connection bracket 42 may be mounted to the bottom of the channels of the respective face mounting brackets 72*a*, 72*b* by conventional means such as bolts. In this configuration, the lifting pole assembly 10 may be mounted to the outside of the tower as shown in FIGS. 9A-9C, or, similar to the embodiment shown in FIGS. 8A-8C, to the inside of the tower as shown in FIG. 9D.

FIGS. 10A-10C show a lifting pole assembly 110 according to yet another embodiment of the present invention in a sling mounted, or basket pole configuration. In this embodiment, the position and tilt of the lifting pole 12 is determined by the relative lengths of the slings 74*a*, 74*b*, 74*c*, and upper support line 74*d* attaching the lifting pole 12 to the tower 100. Because the slings position the lifting pole 12, there is no need for a bottom bracket assembly 14, top bracket assembly 16, or anti-rotation bracket 60. Each of the slings 74*a*, 74*b* and 74*c* has a first end attached to a bracket at the lower end of the lifting pole 12, and a second end attached to a corresponding tower leg 102*a*, 102*b*, 102*c*, respectively, near the upper end thereof. The upper support line 74*d* has a first end connected to tower leg 102*c* near the upper end thereof and a second end connected to a bracket 75 near the upper end of the lifting pole 12. As in the embodiment shown in FIGS. 8A-8C, an adjustable base sheave 136 which can be removably secured to a variety of positions along the length of the lifting pole 12 is provided an adjustable base sheave 136 which can be removably secured to a variety of positions along the length of the lifting pole 12 is provided. As shown in FIGS. 8A-8C, the load line 70 is located outside the tower 100. However, there are other configurations known in the prior art and useful with the present invention wherein the load line may be positioned inside the tower.

As previously discussed, and as shown in FIG. 11, universal clamps 76 may be used in place of u-bolts 24*a*, 24*b*, 26*a*, 26*b* to secure the bottom bracket assembly 14 and top bracket assembly 16 to the tower. FIGS. 12A-12C show a variety of different lifting pole head assemblies 18 that may be used in accordance with the present invention. FIG. 12A shows the lifting pole head assembly as a rooster head 18*a*, FIG. 12B shows a fixed sheave 18*b*, and FIG. 12C shows a tab for block assembly 18*c*. Other head assemblies as known in the art may also be used.

Figure 13:
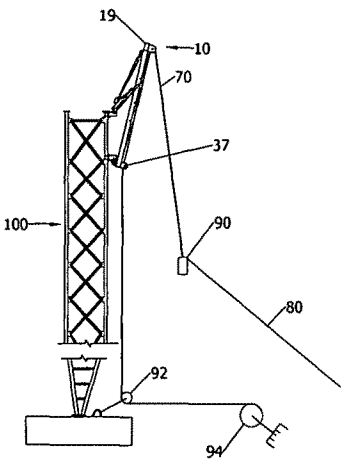
FIG. 13 is a side elevational view of an improved lifting pole according to one aspect of the present invention, shown mounted on a tower in a conventional lift arrangement with a straight tag.

FIGS. 13-16 show the present invention being used in a variety of lift arrangements as are known in the art. FIG. 13 shows the present invention being used in a conventional lift arrangement with a straight tag. In this lift arrangement, a tag line 80 is attached at a first end to the load 90 and extends outwardly and downwardly from the load 90 away from the tower 100. A first end of the load line 70 is attached to the load 90. The load line then passes through the head assembly pulley 19, through the sheave pulley 37 and then downwardly parallel to the tower to a heel block 92 positioned and anchored on or near the ground at or near the base of the tower 100. The load line then extends outwardly away from the tower to a hoist 94 which is used to raise and lower the load 90.

Figure 14:
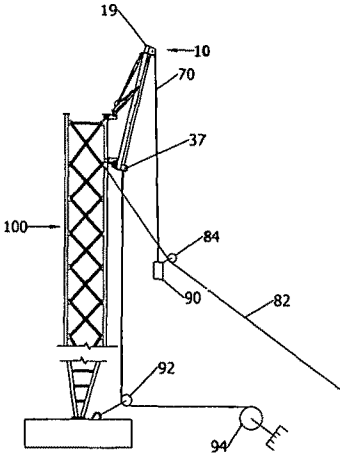
FIG. 14 is a side elevational view of an improved lifting pole according to one aspect of the present invention, shown mounted on a tower in a conventional lift arrangement with a trolley tag.

FIG. 14 shows the present invention being used in a conventional lift arrangement with a trolley tag. In this lift arrangement, a trolley tag line 82 is attached at a first end to the tower 100 at or near the lower end of the lifting pole assembly 10 and extends outwardly and downwardly away from the tower 100. A trolley 84 that runs along the trolley tag line 82 is connected to the load 90. As in the previous example, a first end of the load line 70 is attached to the load 90. The load line then passes through the head assembly pulley 19, through the sheave pulley 37 and then downwardly parallel to the tower to a heel block 92 positioned and anchored on or near the ground at or near the base of the tower 100. The load line then extends outwardly away from the tower to a hoist 94 which is used to raise and lower the load 90.

Figure 15:
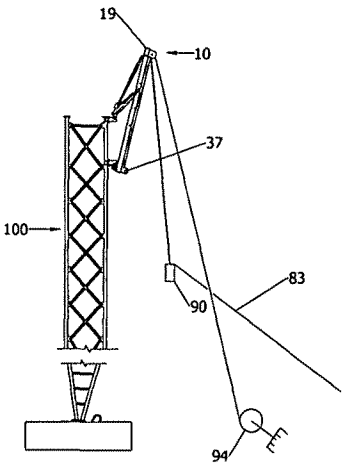
FIG. 15 is a side elevational view of an improved lifting pole according to one aspect of the present invention, shown mounted on a tower in a top block with straight tag arrangement.

FIG. 15 shows the present invention being used in a top block with straight tag arrangement. In this lift arrangement, a first end of the load line 70 is attached to the load 90. The load line then passes through the head assembly pulley 19, and then downwardly and outwardly away from the tower 100 where a second end is connected to a hoist 94 which is used to raise and lower the load 90. A tag line 83 is provided having a first end connected to the load 90 and a second end extending downwardly and outwardly from the load and the tower. As shown in FIG. 15, the second end of the tag line 83 is further away from the tower than the hoist 94.

Figure 16:
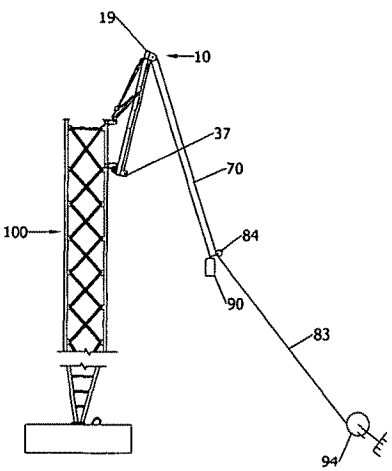
FIG. 16 is a side elevational view of an improved lifting pole according to one aspect of the present invention, shown mounted on a tower in a trolley lift arrangement.

FIG. 16 shows the present invention being used in a trolley lift arrangement. In this lift arrangement, a first end of the load line 70 is attached to the load 90. The load line then passes through the head assembly pulley 19, and then downwardly and outwardly away from the tower 100 in the form of a tag line 83 where a second end is connected to a hoist 94 which is used to raise and lower the load 90. A trolley 84 that runs along the trolley tag line 83 is connected to the load 90.

The various component parts of the lifting pole assembly 10 may be made from a variety of materials, including but not limited to galvanized steel, painted steel, aluminum, carbon fiber, fiberglass, aluminum with carbon fiber, or steel with carbon fiber for example. The components may exhibit a variety of cross-sectional shapes, including but not limited to pipe, square tube, rectangular tube, T-shape, H-beam, built-up sections, or carbon fiber inner pipe with an outer square tube of steel or aluminum, for example.

The foregoing is provided for purposes of illustrating, explaining, and describing embodiments of the present invention. The specific components and order of the steps listed above, while preferred is not necessarily required. Further modifications and adaptation to these embodiments will be apparent to those skilled in the art and may be made without departing from the scope or spirit of the invention.

I claim:

1. A lifting pole assembly configured for removable attachment to a tower comprising:

a lifting pole having a lower end and an upper end;

a bottom bracket assembly having a first end attached to the tower and a second end attached to the lifting pole proximal to the lower end thereof;

a top bracket assembly having a first end attached to the tower at a position above the point where the bottom bracket is attached to the tower and a second end attached to the lifting pole at a position above the point where the bottom bracket is attached to the lifting pole, wherein the bottom bracket assembly and top bracket assembly are removably attached to a face of the tower by a pair of face mounting brackets; and vertical tilt means for enabling the lifting pole to pivot in the vertical plane about a point proximal to the connection between the bottom bracket and the lower end of the lifting pole.

2. The lifting pole assembly of claim 1 wherein the vertical tilt means further comprises:

a flange extending outwardly from the lifting pole proximal to the lower end thereof;

a swivel mount bracket extending from the bottom bracket; and a pivot pin passing through openings in both the flange and the swivel mount bracket to permit rotation about the axis thereof.

3. The lifting pole assembly of claim 2 wherein the vertical tilt means further comprises:

one or more tie-back arms, each said tie-back arm having a first end pivotally attached to a top swivel bracket of the top bracket assembly such that said one or more tie-back arms may rotate in the vertical plane relative to the top swivel bracket and an opening in each of said one or more tie-back arms proximal to a second end thereof;

one or more openings extending through the lifting pole along a longitudinal axis thereof; and a pin configured to pass through said second end openings in said tie-back arms and through one of said one or more openings in the lifting pole to secure the lifting pole at a desired angle.

4. The lifting pole assembly according to claim 3 wherein the vertical tilt means further includes a come-along having a first end removably attached to a bracket extending from the lifting pole proximal to the upper end and a second end removably attached to the top pivot bracket.

5. The lifting pole assembly of claim 1 further comprising horizontal pivot means for enabling the lifting pole to pivot in the horizontal plane relative to the tower.

6. The lifting pole assembly of claim 5 wherein the horizontal pivot means comprises a bottom mount bracket of the bottom bracket assembly having a first end removably attached to the tower and a second end pivotally attached to a bottom swivel pivot bracket by a bottom swivel bolt connection.

7. The lifting pole assembly of claim 6 wherein the horizontal pivot means further comprises a top mount bracket of the top bracket assembly having a first end removably attached to the tower and a second end pivotally attached to a top swivel pivot bracket by a top swivel bolt connection.

8. The lifting pole assembly of claim 5 further comprising an adjustable anti-rotation bracket having a first end attached to a lateral bracket located along the length of the lifting pole and a second end attached to a bracket affixed to the tower.

9. The lifting pole assembly of claim 8 wherein the adjustable anti-rotation bracket comprises a first telescoping member slidably disposed within a second telescoping member; and a fastener for releasably securing the first and second telescoping members from movement relative to one another.

10. The lifting pole assembly of claim 1 wherein the bottom bracket assembly and top bracket assembly are removably attached to a vertical leg of the tower.

11. A lifting pole assembly configured for removable attachment to a tower comprising:

a lifting pole having a lower end and an upper end;

a bottom bracket assembly having a first end attached to the tower and a second end attached to the lifting pole proximal to the lower end thereof;

a top bracket assembly having a first end attached to the tower at a position above the point where the bottom bracket is attached to the tower and a second end attached to the lifting pole at a position above the point where the bottom bracket is attached to the lifting pole;

horizontal pivot means for enabling the lifting pole to pivot in the horizontal plane relative to the tower; and an adjustable anti-rotation bracket having a first end attached to a lateral bracket located along the length of the lifting pole and a second end attached to a bracket affixed to the tower.

12. The lifting pole assembly of claim 11 further comprising a bottom mount bracket of the bottom bracket assembly having a first end removably attached to the tower and a second end pivotally attached to a bottom swivel pivot bracket by a bottom swivel bolt connection.

13. The lifting pole assembly of claim 12 further comprising a top mount bracket of the top bracket assembly having a first end removably attached to the tower and a second end pivotally attached to a top swivel pivot bracket by a top swivel bolt connection.

14. The lifting pole assembly of claim 11 wherein the adjustable anti-rotation bracket comprises a first telescoping member slidably disposed within a second telescoping member; and a fastener for releasably securing the first and second telescoping members from movement relative to one another.

15. The lifting pole assembly of claim 11 further comprising vertical tilt means for enabling the lifting pole to pivot in the vertical plane about a point proximal to the connection between the bottom bracket and the lower end of the lifting pole.

16. The lifting pole assembly of claim 15 wherein the vertical tilt means further comprises:

a flange extending outwardly from the lifting pole proximal to the lower end thereof;

a swivel mount bracket extending from the bottom bracket; and a pivot pin passing through openings in both the flange and the swivel mount bracket to permit rotation about the axis thereof.

17. A lifting pole assembly configured for removable attachment to a tower comprising:

a lifting pole having a lower end and an upper end;

a bottom bracket assembly having a first end attached to the tower and a second end attached to the lifting pole proximal to the lower end thereof;

a top bracket assembly having a first end attached to the tower at a position above the point where the bottom bracket is attached to the tower and a second end attached to the lifting pole at a position above the point where the bottom bracket is attached to the lifting pole;

horizontal pivot means for enabling the lifting pole to pivot in the horizontal plane relative to the tower;

a flange extending outwardly from the lifting pole proximal to the lower end thereof;

a swivel mount bracket extending from the bottom bracket; and a pivot pin passing through openings in both the flange and the swivel mount bracket to permit rotation about the axis thereof;

one or more tie-back arms, each said tie-back arm having a first end pivotally attached to a top swivel bracket of the top bracket assembly such that said one or more tie-back arms may rotate in the vertical plane relative to the top swivel bracket and an opening in each of said one or more tie-back arms proximal to a second end thereof;

one or more openings extending through the lifting pole along a longitudinal axis thereof; and a pin configured to pass through said second end openings in said tie-back arms and through one of said one or more openings in the lifting pole to secure the lifting pole at a desired angle.

18. The lifting pole assembly according to claim 17 wherein the vertical tilt means further includes a come-along having a first end removably attached to a bracket extending from the lifting pole proximal to the upper end and a second end removably attached to the top pivot bracket.

* * * * *